United States Patent [19]

McKenzie

[11] Patent Number: 4,759,306

[45] Date of Patent: Jul. 26, 1988

[54] SUPPORTING ASSEMBLIES

[76] Inventor: Peter H. H. McKenzie, 123 Jubilee Terrace, Bardon, Q. 4065, Australia

[21] Appl. No.: 930,033

[22] Filed: Nov. 10, 1986

Related U.S. Application Data

[63] Continuation-in-part of Ser. No. 713,906, filed as PCT AU84/00117 filed Jun. 26, 1984, published as WO85/00296 on Jan. 31, 1985, abandoned.

[51] Int. Cl.[4] ..... B63B 35/00

[52] U.S. Cl. ..... 114/39.2; 182/112; 294/25

[58] Field of Search ..... 114/39, 39.2, 253; 441/69, 84; 272/68; 294/25-26, 149, 152, 153, 156; 105/354; 224/220, 256, 257, 267, 268, 269; 182/112, 133, 136

[56] References Cited

U.S. PATENT DOCUMENTS

| | | | |
|---|---|---|---|
| 903,015 | 11/1908 | Sinclair | 441/84 |
| 3,496,573 | 2/1970 | Kuchar et al. | 272/68 |
| 3,541,990 | 11/1970 | Dumas | 441/69 |
| 4,235,182 | 11/1980 | Burger | 441/69 |

FOREIGN PATENT DOCUMENTS

| | | | |
|---|---|---|---|
| 2646923 | 4/1978 | Fed. Rep. of Germany | 114/39 |

*Primary Examiner*—Sherman D. Basinger
*Assistant Examiner*—Jesûs D. Sotelo
*Attorney, Agent, or Firm*—McAulay, Fields, Fisher, Goldstein & Nissen

[57] ABSTRACT

A supporting assembly (10) for securing a persons hand to the sail wishbone of a sailboard includes a connected assembly (11) having a pair of mounting devices (14, 15) which may be fitted adjustably about the thumb and wrist, respectively, a connector portion (18) adapted to pass behind the wishbone, and a retention device or bar (16) for retention by finger pressure. Connector portion (18) is formed of flexible resilient material such that upon release of retention device (16) the connector portion momentarily tends to straighten and disengage from the wishbone. A body harness or cable may be secured to connection (23). Alternative forms of the supporting assembly (10) which do not differ substantially from the preferred alternative are also disclosed. The supporting assembly is adapted for use in other sports, for example by gymnasts, or in industry, for example by riggers.

20 Claims, 7 Drawing Sheets

FIG. 5
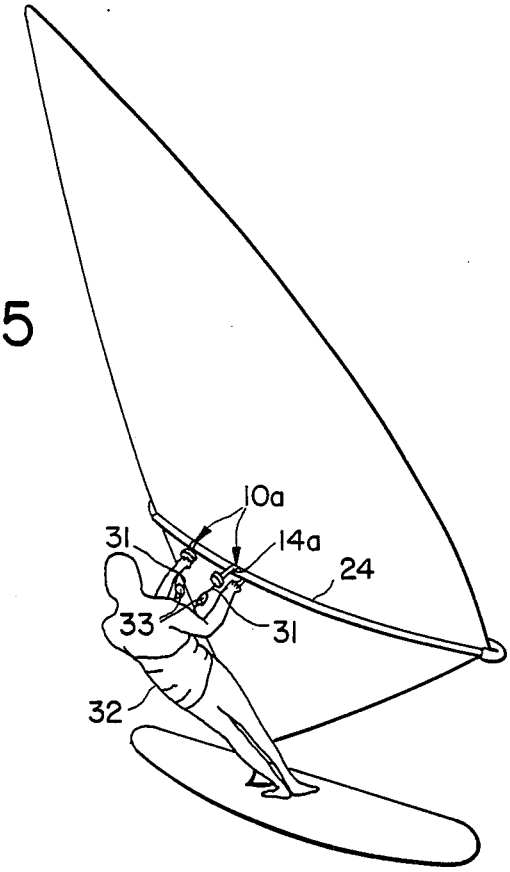
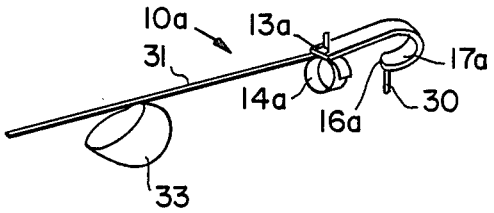
FIG. 4

FIG. 13
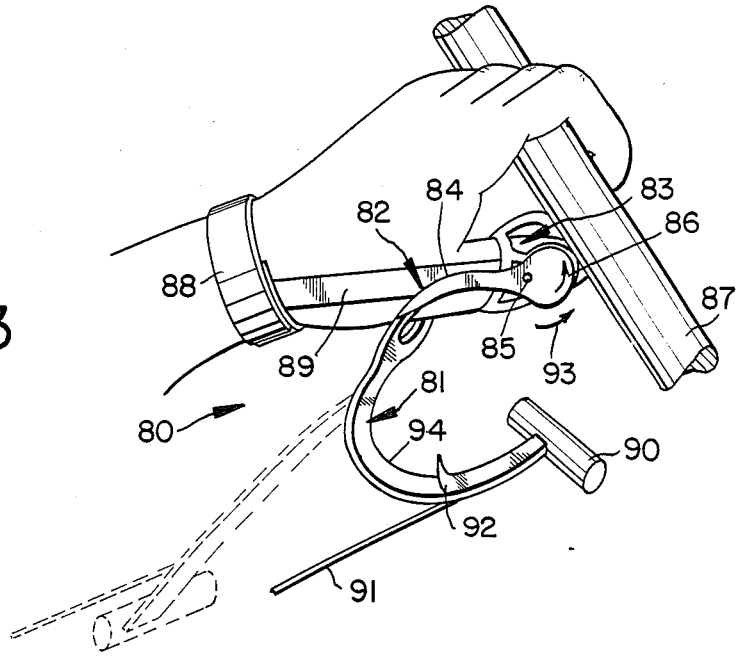
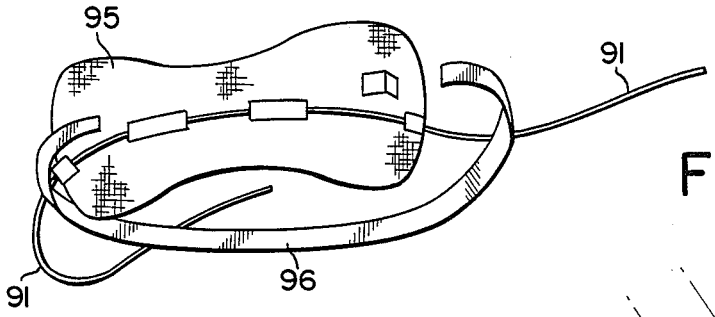
FIG. 15
FIG. 14
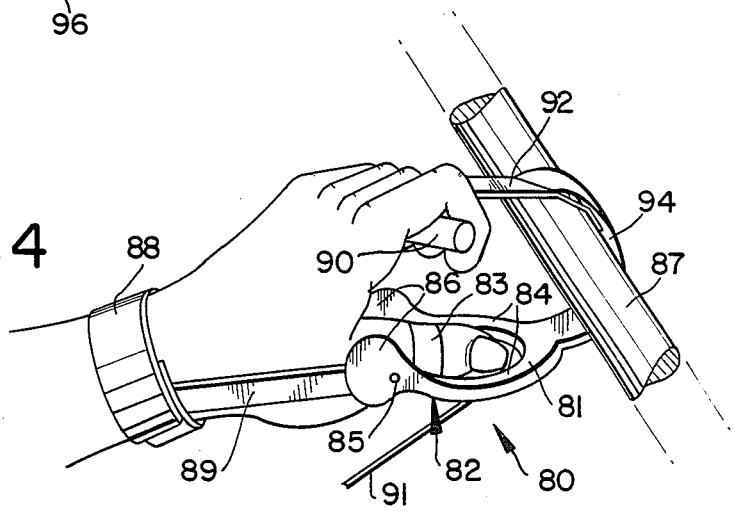

SUPPORTING ASSEMBLIES

This application is a continuation-in-part of U.S. patent application Ser. No. 713,906, filed as PCT AU 84/00117 filed Jun. 26, 1984, published as WO 85/00296 on Jan. 31, 1985, now abandoned.

This invention relates to supporting assemblies suitable for securing a person's hand to a support member such as a bar or the like.

The present invention has particular but not exclusive application for seucring a person's hand or hands to the sail wishbone of a sailboard and for simplicity it will be described hereinafter with reference to this application. Of course this invention could be used in other sports, for example by gymnasts, or in industry, for exmple by riggers or the like.

When sailing a sailboard it is necessary for the user to be able to securely grip the wishbone, usually with both hands, in order to support himself and the sail to control the position of the sail and so maintain the sail erect by counterbalancing the sail force with the user's body weight. Provided the sail is correctly positioned and held erect at the selected inclination a forward thrust is produced to push the sailboard either through the water or along the ice or other supporting surface. In this respect it will be understood that the term sailboard is used herein to cover all sailing machines having an unsupported sail assembly adapted to be controlled by a user as described above.

Because the user's body weight is used to support the sail, sailing sailboards can be a strenuous sport especially if sailing continues for a long period of time. In the past, efforts have been made to provide body harnesses attachable to the wishbone to support the user whereby the strain on the user's arms can be relieved.

For example, German Specification No. 2930598 of Zoor illustrates a body harness which is adapted to hook onto a sling there being one fixed at each side of the wishbone. This arrangement has the disadvantage that the slings are fixed to the boom and thus the necessary fine or large adjustment in the relative positions between the user and the sail for precise directional control and variations in relative windspeed can not be achieved while supporting by the sling.

Attempts have been made to overcome this disadvantage by providing adjustable harness attachment slings such as is illustrated in French specification No. 2493796 of Martin. However such arrangements remain unsatisfactory because of the inability of the user to infinitely vary the effective centre of support of his body weight, such as an unsupported user can be by varying the relative amounts of body weight supported by the respective arms when sailing without a harness. Furthermore, in use it is difficult to adjust the harness supports along the wishbone to the requisite positions.

These disadvantages have been alleviated by the use of hooks adapted to be associated with a user's hand and connected by lines to a body harness. In such cases the hook may be moved along the wishbone to achieve the necessary balance. Such arrangements are illustrated in German Specification Nos. 2729228 and 2757545 of Burger. However such harness arrangements may be awkward to use, particularly when going about as the placement of the hook in the hand of the user is cumbersome and prevents the user from using his hand for other purposes unless the hook is removed from the hand. Then it may be difficult to reposition the hook, particularly if it is disengaged from the wishbone.

A further disadvantage associated with such devices is that if the sailboard should experience a sudden gust of wind the user may not be able to release the hooks from the wishbone and the user may be catapulted with the sail into the water. This can and has caused serious injuries to sailboard riders.

The present invention aims to alleviate the abovementioned disadvantages and to proivde a supporting assembly which will be reliable and efficient in use. Other objects and advantages of this invention will hereinafter become apparent.

With the foregoing and other objects in view, this invention, in one aspect, resides broadly in a supporting assembly for supporting a user, including: a connector assembly arranged for connection to a support member; hand operated retention means associated with said connector assembly and operable to maintain said connector assembly operatively connected to the support member.

Preferably the connector assembly includes a connector portion adapted to pass behind the support member for support thereby and said retention means includes a free end portion thereof adapted to be held by the hand. Preferably the connector portion is formed of flexible resilient material such that upon release of the free end portion the connector portion bends to release from behind the member. Alternatively the connector portion could be rigid and adapted to move pivotally from behind the member. The retention means could be the handles of a pliers-type mechanism, the jaws thereof being adapted to engage about the support member to constitute said connector assembly.

In a further embodiment the connector assembly is in the form of a spigot adapted to be retained in one of a plurality of sockets in the support member by retention means in the form of a pawl biassed to a retracted disengaged position in the spigot and adapted to be extended for retention in the socket by the application of hand pressure on suitable holding means on the spigot.

In a preferred form the connector assembly includes a stem having a base part adapted to be secured to one hand portion such as the wrist, thumb or a forefinger and to extend therefrom about the support member to a free end portion thereof which constitutes said retention means which can be engaged by another hand portion to retain the connector assembly engaged about the member. The retention means can be retained by finger pressure adapted to prevent unravelling of the connector portion from about the member, as the connector portion would tend to straighten for disengagement. The retention means could be provided as a bar to enable the user to hook the end portions of the fingers thereover for retention. Alternatively the free end portion could be provided with a hook adapted to be engaged by a complementary hook on a further portion of the connector assembly associated with said another hand portion. In another embodiment the connector portion could extend from a wrist connection over the back of a user's hand to extend about the member to locate its free end portion or retention means in a position in which it may be held between the thumb and fingers. If desired the length of the connector assembly may be selectively adjustable.

It is also preferred that the base part of the connector portion be provided with harness connection means for connection to a harness which may be of conventional form of which may include elbow slings whereby the effective length of the harness connection between the user's body and the connection means may be selectively varied by bending the respective arm. The arrangement may also provide a direct connection between the connection means and the elbow slings such that substantially all or a selected portion of the user's body weight may be supported from the support member by the elbows.

In another aspect this invention resides broadly in a sailboard harness including body restraint means and a pair of lines interconnecting said restraint means with respective supporting assemblies made in accordance with any one of the above described assemblies.

In order that this invention may be more readily understood and put into practical effect, reference will now be made to the accompanying drawings which illustrate various embodiments of the invention, wherein:

FIG. 4 is a perspective view of another form of the invention;

FIG. 5 is a perspective view illustrating a typical application of the embodiment of FIG. 4;

FIGS. 13 to 15 illustrate yet another embodiment of the invention.

Figure 1:
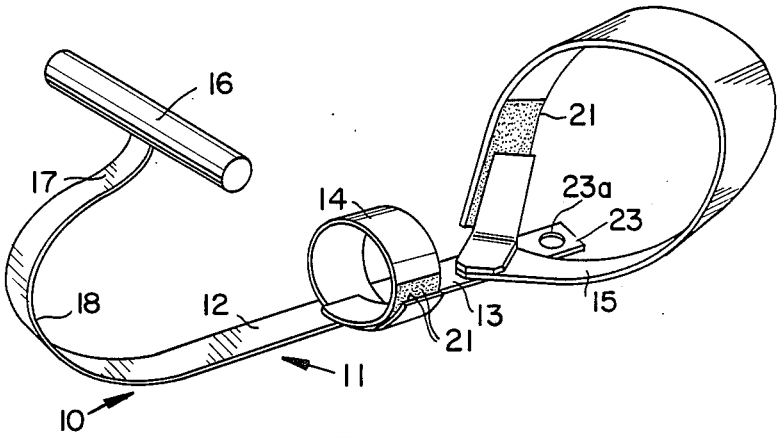
FIG. 1 is a perspective view of a preferred form of supporting assembly according to the present invention.
Figure 2:
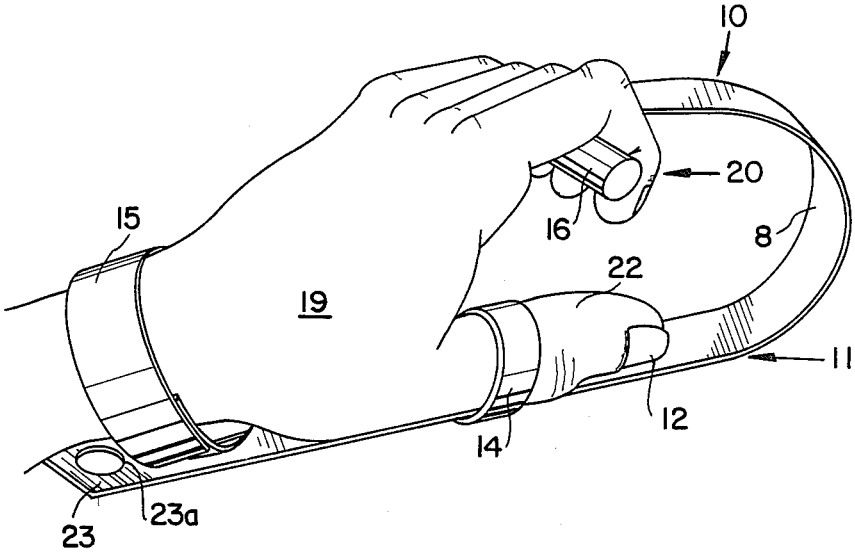
FIG. 2 is a perspective view illustrating the application of the supporting assembly of FIG. 1.
Figure 3:
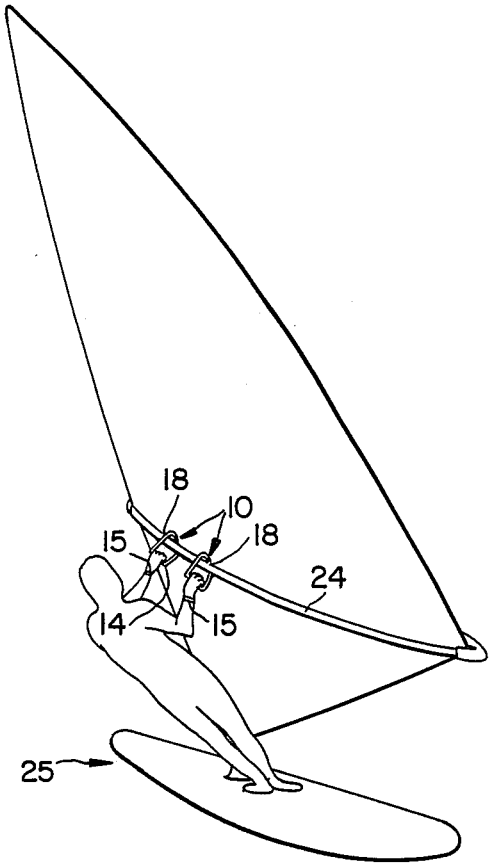
FIG. 3 is a perspective view illustrating the use of a pair of such supporting assembly for sailboarding.

Referring to FIGS. 1 to 3 it will be seen that a preferred form of supporting assembly 10 includes a flexible resilient connector assembly 11 formed of a plastics material and including a support stem 12 extending from a base part 13, on which a pair of mounting means 14 and 15 are secured, to retention means 16 in the form of a T-bar handle 16 at the free end portion 17 thereof. The connector portion 18 intermediate the base part 13 and the retention means 16 is curved such that when the supporting assembly 10 is secured to a hand 19, the T-bar handle 16 is located conveniently for retention by the finger tips 20. For this purpose it will be seen that the mounting means 14 is in the form of a band fixed at one end to the base part 13 and fitted with VELCRO connector pads 21 whereby the band may be secured adjustably about the thumb 22. The other mounting means 15 is of similar construction but it is adapted to be secured about the wrist as illustrated. The bands may be formed of any suitable material which preferably does not chafe the user, such as a layer of elasticized textile fabric with an internal layer of flexible foam material bonded to it. The base part 13 extends beyond the wrist mounting means 15 to provide a connection 23 for a body harness line or cable. For this purpose the free end of a line may be tied through the aperture 23*a*.

In use, the supporting assembly 10 is secured to the wrist and thumb as illustrated in FIG. 2 whereby the T-bar handle 16 may be moved relative to the fingers 20 by appropriate movement of the thumb 22 to enable the user to grasp a support member with his hand. However, in normal use the wishbone 24 (see FIG. 3) of a sailboard 25 can be used to support the user through the supporting assemblies 10. The latter are engaged by manipulating the hand upwards towards the wishbone 24 to place the connector portion 18 about the wishbone 24 with the T-bar handle 16 thereabove the adjacent the fingertips 20. The latter may then be placed over the T-bar such that the hand and the connector assembly 11 form an enclosed loop extending about the wishbone 24. The hand can then be pulled back so that the connection is formed with the wishbone. Most of the pull from the wishbone 24 will be transmitted through the connector assembly 11 directly to the wrist mounting means 15 to free the strain on the fingers and their associated muscles in the forearm. In this respect the resilience of the connector portion 18 is such that its hook shape will tend to straighten under normal loads to enable it to release from the wishbone, but it is sufficiently rigid that only a light finger pressure is required on the retention means to maintain the connector portion in its hook shaped supporting attitude.

If desired a harness can be connected to the respective base parts at 23 to permit the strain to be taken directly by the harness. It will be seen that the positions at which the respective supporting assemblies 10 engage the wishbone 24 may be readily varied by moving the hands in similar manner to normal operation.

If during operation the wishbone 24 has to be quickly released, the finger pressure on the T-bar handle 16 is released and the flexible resilient connector portion 18 will momentarily tend to straighten and unhook from the wishbone 24. Furthermore the resilience of the connector portion may be such that abnormal loadings automatically straighten the connector portion such that it unhooks from the wishbone.

In the embodiment illustrated in FIGS. 4 and 5 each supporting assembly 10*a* includes a flexible resilient support stem 12*a* having a wrist band 14*a* on the base part 13*a*. The retention means 16*a* is provided with a bar 30 adapted to be grasped by the hands. In use the stem 12*a* may be connected to the respective wrists to pass above the hands and about the wishbone 24 whereby the free end portions 17*a* may be retained by grasping the bars 30. The supporting assembly 10*a* may be connected to respective harness straps 31 which lead to a body harness 32. Elbow slings 33 may be connected to the straps 31 intermediate their ends such that the user's weight may be transferred from the elbows to the supporting assemblies 10*a*. If desired the supporting assemblies 10*a* can be used connected to a suitable harness and without engagement with the wrists of the user, as illustrated in FIG. 5. In use, in either arrangement, release of the bars 30 will provide instant release of the supporting assemblies 10*a* from the wishbone.

Figure 6:
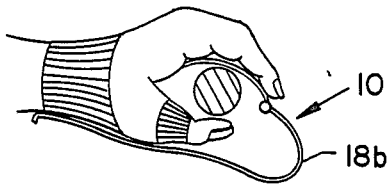
FIGS. 6 to 12 illustrate further embodiments of this invention.

FIG. 6 illustrates a supporting assembly 10*b* which is similar to that illustrated in FIG. 1 but wherein the connector portion 18*b* is elongated to enable a user to lean back further from the wishbone.

Figure 7:
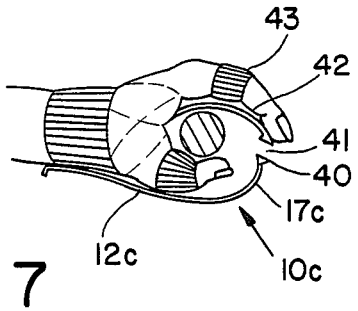

FIG. 7 illustrates a supporting assembly 10*c* having an arrangement wherein the free end portion 17*c* of the stem 12*c* is provided with a ramped latch member 40 adapted to releasably engage with a complementary latch member 41 on a branch 42 of the support stem 12*c*. The branch 42 is provided with a finger mounting strap 43 for manipulation thereby.

Figure 8:
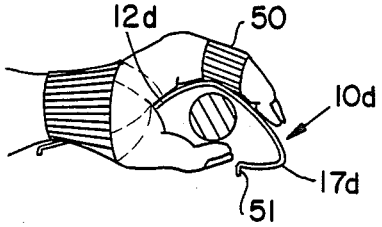

FIG. 8 illustrates a supporting assembly 10*d* wherein the support stem 12*d* extends against the palm of the hand and is adapted to be connected to a finger by a suitable mounting 50. The free end portion 17*d* is hooked at 51 for retention by the thumb.

Figure 9:
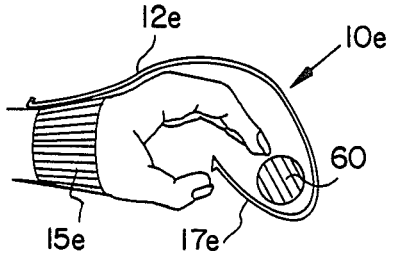

FIG. 9, illustrates a supporting assembly 10*e* wherein the support stem 12*e* extends from a wrist mount 15*e* above the hand for return about a member 60 with the free end portion 17*e* being disposed for grasping between the thumb and forefingers.

Figure 10:
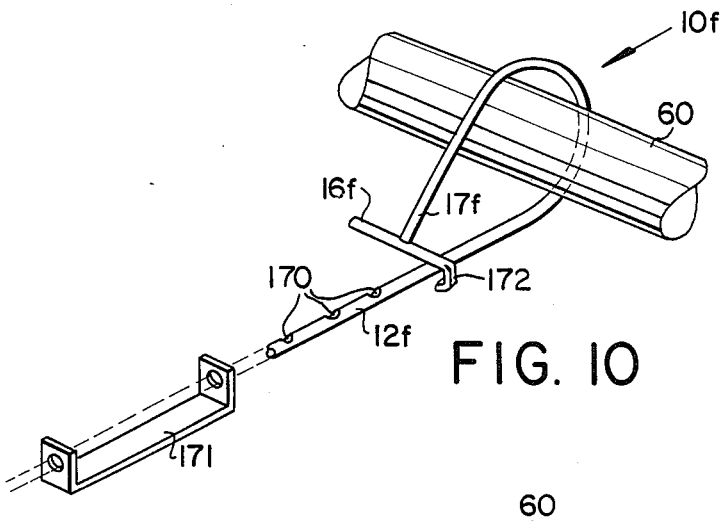

In the supporting assembly 10f illustrated in FIG. 10 the support stem **12*f* is notched at 170 at intervals therealong for selective adjustable engagement with a bracket 171 adapted to be connected to a suitable mounting (not shown). Additionally it will be seen that one end of the T-bar handle 16f is provided with a hook 72 such that in use, the free end portion 17*f* of the stem 12*f* may be moved sideways to engage the hook 172 about the stem 12*f* so as to form a loop about a member 60 and provide retention thereabout, independent of finger pressure applied to the T-bar handle 16*f*. This arrangement may be used during long sailing periods to relieve strain on the hand. Of course the supporting assembly 10*f* may be quickly unlatched by finger movement to firstly disengage the hook 172** and then release as described above.

Figure 11:
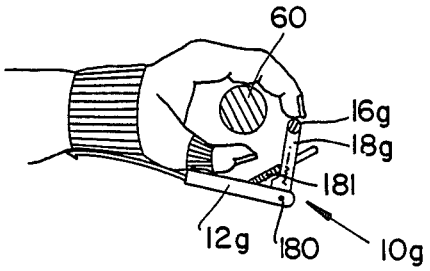

FIG. 11 illustrates a supporting assembly **10*g* wherein the stem 12*g* and the intermediate connector portion 188 are formed of rigid material such as metal and are pivotally connected together at 180 and provided with spring biasing means 181 to bias them to their operative attitude as illustrated such that the T-bar handle 16*g* can be engaged by the fingers. Upon release of the finger pressure the intermediate connector portion 18*g* will pivot downwardly to free the attachment means 10*g* from the bar 60**.

Figure 12:
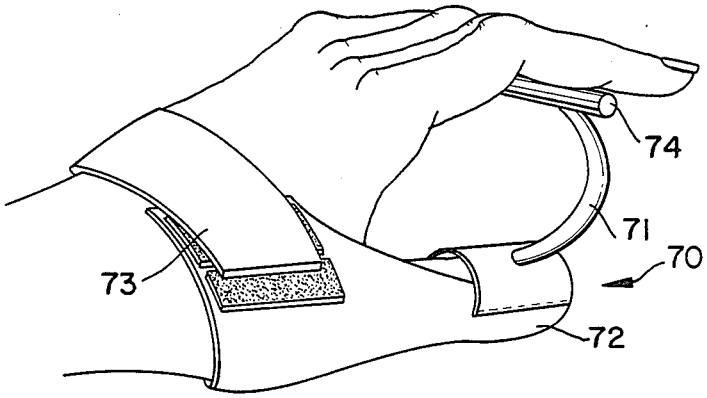

A further embodiment of the invention is illustrated in FIG. 12. This assembly 70 includes a resilient hook member 71 releasably connected to a pouch 72 formed of a fabric material or the like and adapted to be fitted to the end of the thumb. The pouch 72 is formed integrally with a wrist band assembly 73 which may be fitted adjustably about the wrist. The hook member 71 extends only part way around the bar or member to which the hand is to be secured, and in use, as illustrated the fingers overlie the hook T-bar 74 to retain the hook 71 in position. When the fingers are released the hook member 71 uncurls from the bar for release therefrom. Interchangeable hooks 71 may be used with this assembly.

If desired the hook member 71 could be formed as a substantially rigid component. In such embodiments the hook would release from the bar by pivoting sideways about the thumb subsequent to the fingers being released from their retaining position overlying the hook end.

In the embodiment utilizing a flexible hook or connector portion, frictional engagement between the hook or connector portion and the appropriate bar or member to which the supporting assembly is secured is enhanced because of the ability of the hook or connector portion to deform and conform to the shape of the bar or member. Thus relatively light retention pressure is required for operative engagement with the bar or member.

The supporting assembly 80 illustrated in FIGS. 13 and 14 has a hooked flexible connector assembly 81 provided with a forked mounting end 82 pivotally attached to a thumb mount 83 whereby it may pivot about the thumb from an inoperative position, as shown in FIG. 13, to an operative engaged position as shown it FIG. 14. The legs 84 of the forked end 82 project beyond their pivot mountings with the thumb mount 83 to form can shaped ends 86 which may be engaged with the bar 87 distant from the pivot axis 79 so that the flexible connector means 81 may be pivoted about the bar 87 by movement of the user's thumb.

The thumb 83 is secured to a releasable wrist strap 88 by opposed connectors 89, only one of which is shown, whereby in use the supporting load can be transferred from the thumb mount 83 directly to the wrist strap 88. The free end of the flexible connector means 81 is provided with a finger grip 90 and a harness line 91 passes adjustably through an aperture 92 therein adjacent the finger bar 90. The length of the harness line 91 is suitably adjusted so that when the supporting assembly is operatively positioned with the line 91 passing around the bar 87, the user's arm is bent in a comfortable manner. However, this does not prevent the arm from being fully stretched since the length of the line 91 may be effectively lengthened by the length of the outstretched flexible connector means 81, as illustrated in dotted outline in FIG. 13. Such action also pulls the supporting assembly 80 to its inoperative position at which it does not interfere with normal use of the hand.

In use the user may grasp the bar 87 in a normal manner as shown in FIG. 13. Thereafter by moving the thumb upwardly to engage the cams 86 with the bar 87 and the flexible connector means 81 may be pivoted about the bar 87 by moving the thumb forwards as indicated by arrow 93 to cause the flexible connector means to pivot about its mounts 85 to position the finger grip 90 on the opposite side of the bar 87 at which it may be held by the user's fingers. The hand may then be freed from the bar which will be received and held in the U-shaped base part 94 of the flexible connector means 81. If the bar 87 is tending to pull away from the user it can be easily released by slipping the fingers from the grip 90 and allowing the hooked flexible connector 81 to straighten out so as to release from the bar 87.

The harness line 91, as shown in FIG. 15 may extend continuously between a pair of supporting assemblies 80 and pass slidably through a body support 95 adapted to be secured to a user by strap 96. The body support is preferably located at the back of the user but it may be disposed at the front if desired. Thus the user may easily balance the supporting force applied to each assembly 80 by varying the lengths of the respective line runs between the body support 95 and each assembly 80.

The supporting assembly can be formed of any suitable material and the mounting means could be in the forms of ties or straps and buckles or any other conventional form. If desired the supporting assembly could be formed as a one piece plastics article with the mounting means being formed as apertured strap-like bands adapted for adjustable connection about the wrist or hand portions in known manner.

Of course the above has been given by way of illustrative example only and it will be realised that all such modifications and variations thereto as would be apparent to persons skilled in the art are deemed to fall within the broad scope and ambit of the invention as defined in the appended claims.

The claims defining the invention are as follows:

1. A quick release supporting assembly including:
mounting means securable to a user's arm;
retention means engageable by and controllable by a finger of the user's arm;
flexible connector means extending from said mounting means to said retention means and formed whereby it extends about a bar-like support member spaced beyond the user's grasp;
wherein said connector means is connectable to said support member by maintaining a finger engaged with said retention means such that the user's arm and said connector means cooperate to form a closed loop extending about the support member and wherein said flexible connector means will disconnect from the support member upon release of said retention means from the finger engaged with said retention means.

2. A quick release supporting assembly according to claim 1, including securing means adjacent said mounting means for securing a harness thereto.

3. A quick release supporting assembly according to claim 2, wherein said flexible connector means is an elongate member formed of plastics material which extends from said retention means to and beyond said mounting means and wherein said securing means includes a portion which extends beyond said mounting means.

4. A quick release supporting assembly according to claim 1, wherein said mounting means includes an adjustable band adapted to be secured about the wrist portion of the user's hand.

5. A quick release supporting assembly according to claim 1, wherein said mounting means includes an adjustable band adapted to be secured about the base portion of the user's hand.

6. A quick release supporting assembly according to claim 1, wherein said mounting means further includes attachment means on said flexible connector means and adapted to locate said flexible connector means for movement with the user's thumb.

7. A quick release supporting assembly according to claim 1, wherein said flexible connector means is formed in a hook-like configuration from a resilient material whereby in use upon release of said retention means and upon the application of a relatively small separating force applied between the arm and the support member, the hook-like configuration of said connector means will open to disconnect from the support member.

8. A quick release supporting assembly according to claim 2, wherein said flexible connector means is formed of resilient plastics material and is provided with securing means thereon for securing a harness thereto.

9. A quick release supporting assembly according to claim 7, wherein a relatively light finger pressure applied to said retention means will retain said flexible connector means connected about said support member.

10. A quick release supporting assembly according to claim 1, wherein said retention means includes a T-bar handle engageable by the finger and releasable upon release of finger pressure.

11. A quick release supporting assembly according to claim 1, wherein the length of said flexible connector means is selectively variable.

12. A quick release supporting assembly according to claim 1, including releasable latching means for securing together spaced portions of said retention means to form the latter in a closed loop about a support member.

13. A quick release supporting assembly of the type including:

mounting means securable to a user's arm;

retention means engageable by a finger of the user's arm; and flexible connector means extending said mounting means to said retention means whereby it is looped about a bar-like support member spaced beyond the user's grasp and wherein in use the user's hand and said connector means cooperate to form a closed loop connection extending about the support member which connection is maintained by holding a finger engaged with said retention means and which connection is released from the support member upon freeing the engaged finger from engagement with said retention means.

14. A sailboard harness assembly including:

a pair of supporting assemblies as defined in claim 13;

a harness line passing between said supporting assemblies and a body support securable to a user's body and adapted to slidably support said harness line.

15. A quick release supporting assembly, including:

mounting means securable to a user's arm;

connector means which in use extends from said mounting means to engage about a bar-like support member spaced beyond the user's grasp, and retention means for retaining said connector means in its engaged position;

said connector means being formed of a flexible material whereby in use, the user's fingers and said connector means cooperate to form a closed loop connection extending about the support member which connection is maintained by holding a finger engaged with said retention means and which connection is released from the support member upon freeing the engaged finger from engagement with said retention means.

16. A quick release supporting assembly according to claim 15, wherein said flexible connector means is in the form of a flexible hook which is pivotally attached at its mounting end to said mounting means, said flexible hook having a hooked end whereby its hooked end is movable pivotally from an inoperative position to its operative supporting position.

17. A quick release supporting assembly according to claim 16, wherein said mounting end extends beyond its pivotal attachment to said mounting means whereby it is engageable with said support member to cause pivotal movement of said hooked end.

18. A quick release supporting assembly according to claim 17, wherein said mounting means includes a thumb mounting attached by load transmitting members to an arm mounting.

19. A quick release supporting assembly according to claim 18, wherein said hooked end is provided with harness line attchment means whereby said supporting assembly can be connected to a body harness line.

20. A saidboard harness assembly including:

a pair of supporting assemblies as defined in claim 19;

a harness line passing between said supporting assemblies and a body support securable to a user's body and adapted to slidable support said harness line.

* * * * *